US007059575B2

(12) United States Patent
Garton

(10) Patent No.: US 7,059,575 B2
(45) Date of Patent: Jun. 13, 2006

(54) INDUSTRIAL TANK SUPPORT

(75) Inventor: Darwin Garton, Lincoln, NE (US)

(73) Assignee: Snyder Industries, Inc., Lincoln, NE (US)

( * ) Notice: Subject to any disclaimer, the term of this patent is extended or adjusted under 35 U.S.C. 154(b) by 0 days.

(21) Appl. No.: 10/637,888

(22) Filed: Aug. 7, 2003

(65) Prior Publication Data

US 2005/0029425 A1 Feb. 10, 2005

(51) Int. Cl.
*A47B 91/00* (2006.01)
*B65D 19/38* (2006.01)

(52) U.S. Cl. ..... 248/346.01; 248/146; 108/57.1; 108/55.5

(58) Field of Classification Search ..... 248/346.01, 248/346.03, 346.2, 346.5, 910, 907, 346.02, 248/678, 676, 146, 154, 188.2, 163.2; 108/57.1, 108/55.5, 55.1; 220/13, 57.1
See application file for complete search history.

(56) References Cited

U.S. PATENT DOCUMENTS

| | | | | | |
|---|---|---|---|---|---|
| 839,062 | A * | 12/1906 | Gagnon | 248/172 |
| 2,657,891 | A * | 11/1953 | Van Haften et al. | 248/146 |
| 2,988,333 | A * | 6/1961 | Mesic | 165/80.5 |
| 3,255,927 | A * | 6/1966 | Ruppert, Jr. et al. | 222/143 |
| 3,563,184 | A * | 2/1971 | Angelbeck, Jr. | 108/53.1 |
| 3,636,888 | A * | 1/1972 | Angelbeck, Jr. | 108/53.1 |
| 3,709,163 | A * | 1/1973 | Smedley et al. | 108/53.5 |
| 3,776,435 | A * | 12/1973 | Smith | 222/566 |
| 4,848,711 | A * | 7/1989 | Mandel | 248/154 |
| 5,117,402 | A * | 5/1992 | Myers et al. | 367/143 |
| 5,197,601 | A * | 3/1993 | Sterett | 206/511 |
| 5,490,603 | A * | 2/1996 | Davis | 220/4.12 |
| 5,520,121 | A * | 5/1996 | Schubart et al. | 108/57.1 |
| 5,533,456 | A * | 7/1996 | Regina | 108/57.29 |
| 5,746,405 | A * | 5/1998 | Dvorak et al. | 248/146 |
| 6,247,594 | B1 * | 6/2001 | Garton | 206/512 |
| 6,505,429 | B1 * | 1/2003 | Percival | 42/94 |

* cited by examiner

*Primary Examiner*—Anita M. King
(74) *Attorney, Agent, or Firm*—Hovey Williams, LLP

(57) ABSTRACT

An industrial tank support includes a platform and multiple supporting legs positioned around the platform with the platform located between the top end and bottom end of the legs. The platform has first and second surfaces thereon which have different configurations, whereby the tank support can be positioned in two different orientations with either the first surface or the second surface uppermost in a tank receiving position to alternatively support tanks having two different bottom configurations. A central opening is provided in the platform whereby a dispensing outlet or other projection from the bottom wall of the supported tank may extend through the central opening. The legs and platform are preferably hollow and in fluidic communication by passages, and the tank support is preferably molded as a unitary member of synthetic resin.

24 Claims, 6 Drawing Sheets

INDUSTRIAL TANK SUPPORT

BACKGROUND OF THE INVENTION

1. Field of the Invention

The present invention concerns supports which are used to support and elevate tanks which hold liquids above a supporting surface. More particularly, it is concerned with a tank support which may be economically constructed of synthetic resin and capable of supporting tanks with both flat and sloped bottom surfaces.

2. Description of the Prior Art

Tanks are used to hold a variety of different liquids. Some of those liquids are corrosive and need to be protected from impact which can cause leakage. In an industrial environment, the tanks are used to hold and dispense liquids, and it is beneficial for the tanks to be supported above a floor or other surface. By supporting the tank above the surface, leaks and spills are more readily detected and cleaned, access is made easier, the dispensing outlet may be located on the bottom wall of the tank to fully drain the contents, and forklifts or other machines may be easily placed beneath the tank to lift and move it to a new location.

One way of elevating tanks containing liquid above a surface is a pallet. Pallets are typically made of wood and permit the use of forklifts for moving the tank. However, it is difficult to detect leakage and spills, and it is usually not possible to place the dispensing outlet on the bottom wall of the tank. Moreover, pallets provide no peripheral protection for the tank against impact by trucks, forklifts, or other equipment.

One type of tank support which provides a number of advantages over pallets and the like is shown in U.S. Pat. No. 5,490,603, the disclosure of which is incorporated herein by reference. This patent shows a tank apparatus which includes a tank, a base for supporting the tank, and a top protector. The base includes a plurality of upright supports which are spaced around the tank and receive the top protector whereby the tank apparatus can be stacked. The base is made of synthetic resin and supports the tank above the floor or other surface.

SUMMARY OF THE INVENTION

The present invention presents an alternative to the support shown in the U.S. Pat. No. 5,490,603 with significant advantages. Broadly speaking, the present invention includes a tank support having a platform with a plurality of legs connected thereto which elevates the platform above the supporting surface, with the platform presenting two opposite surfaces designed for tanks with different bottom surface configurations. Thus, the legs, which extend both above and below the platform in either orientation, elevate the platform above the floor or other surface and provide peripheral protection around the bottom of the tank supported thereon. One surface of the platform may be configured for a flat-bottomed tank, while the other surface may be configured complemental to a dome-shaped, conical or otherwise inclined bottom walled tank, a tank with one or more ridges or projections, or in other configurations which will readily receive a tank in an upright, stable orientation.

In preferred embodiments, the tank support is rotationally molded of synthetic resin material which is resistant to many corrosive chemicals. Further, the tank support may be hollow, with the legs in fluid communication with the hollow interior of the platform. In this way, water, sand or the like may be poured into the tank support for use as ballast as an anchoring aid. The platform is preferably configured with a recess on at least one of the first and second surfaces which is complemental to the diameter of the tank to be received thereon, which recess serves as a stabilization and locating aid for a tank with a sloped bottom wall. Moreover, the platform may most preferably be provided with interior upright walls extending between the first and second surfaces and most preferably located proximate to the legs for enhanced strengthening of the platform.

The tank support may also be provided with transverse slots in the legs which may be used with strapping as an aid in retaining the tank thereon. The tank support is provided with multiple legs, and may be provided with more legs (e.g. 4, 6, or more) for additional support, strength and stability on uneven surfaces, and to provide even greater protection. Preferably, the platform is provided with a central passage, whereby a drain outlet may be located in the passage, thereby enhancing the ability of the tank to drain of all the liquid received therein while protecting the outlet from damage by impact from equipment. Stands, stirrers, and other auxiliary equipment may be coupled to the legs of the tank support and thereby positioned in proximity to the tank, such that the tank support hereof performs an additional function of an equipment support as well as a tank support.

In use, the tank support is placed on the floor or other surface and the tank placed thereon. Depending on the bottom configuration of the tank the user can invert the tank support prior to tank placement. For example, if a first tank to be supported has a substantially flat bottom, then the tank support is positioned with the flat surface of the platform facing upwardly. If, after removal of a first tank, a second tank with a domed bottom is to be supported, the tank support is inverted so that the concave surface of the platform is uppermost, and then the tank is placed thereon. If desired, water, sand or other ballast may be poured into the tank support legs by cutting an opening in one end of the legs, and the opening may be closed by use of a cap or plug. If it is desired to anchor the tank support to the floor by using bolts or screws, a hole may be cut in the bottom end of the legs complemental in size to the bolt projecting upwardly from the floor, or a screw to be inserted into the floor. Then the tank support is positioned so that the bolt or screw passes through the hole, with the now top end of the legs cut open so that access may be gained to thread a nut onto the bolt or to turn the screw tightly against the bottom end.

These and other advantages of the present invention will be readily appreciated by those skilled in the art with reference to the detailed description and the drawings.

DESCRIPTION OF THE PREFERRED EMBODIMENT

Figure 5:
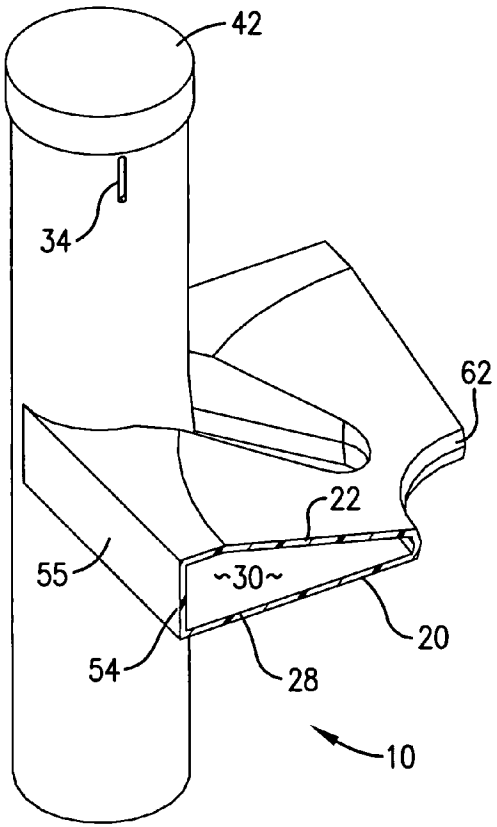
FIG. 5 is an enlarged, fragmentary vertical sectional view taken through the platform to show the separation and orientation of the first and second supporting surfaces on the platform, with a first supporting surface being substantially flat and horizontal in an unloaded condition, and the second surface being inclined downwardly toward the central passage.
Figure 6:
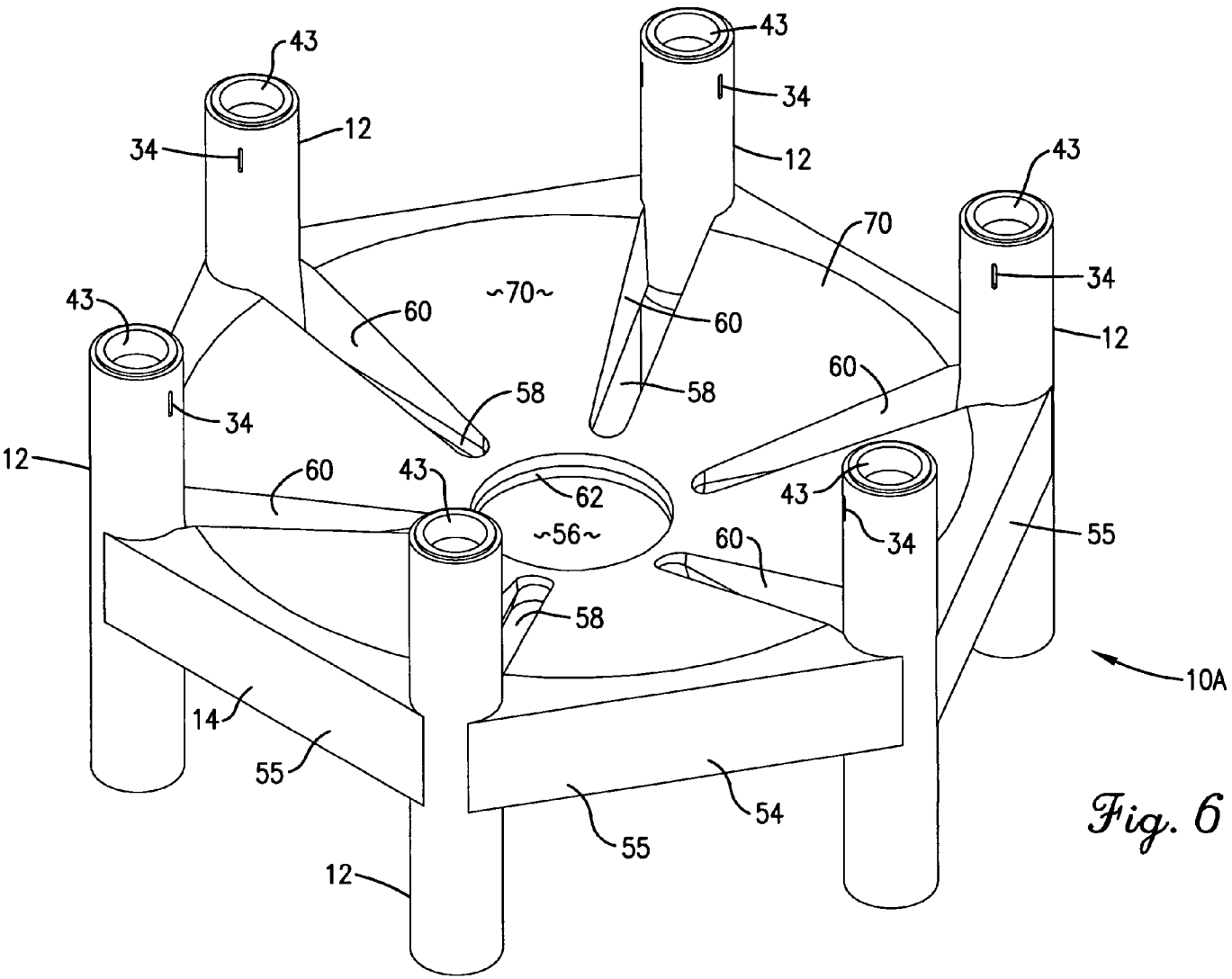
FIG. 6 is a perspective view of a second embodiment of the tank support of the present invention, which is similar to the first embodiment but including six legs and plugs into the legs.
Figure 7:
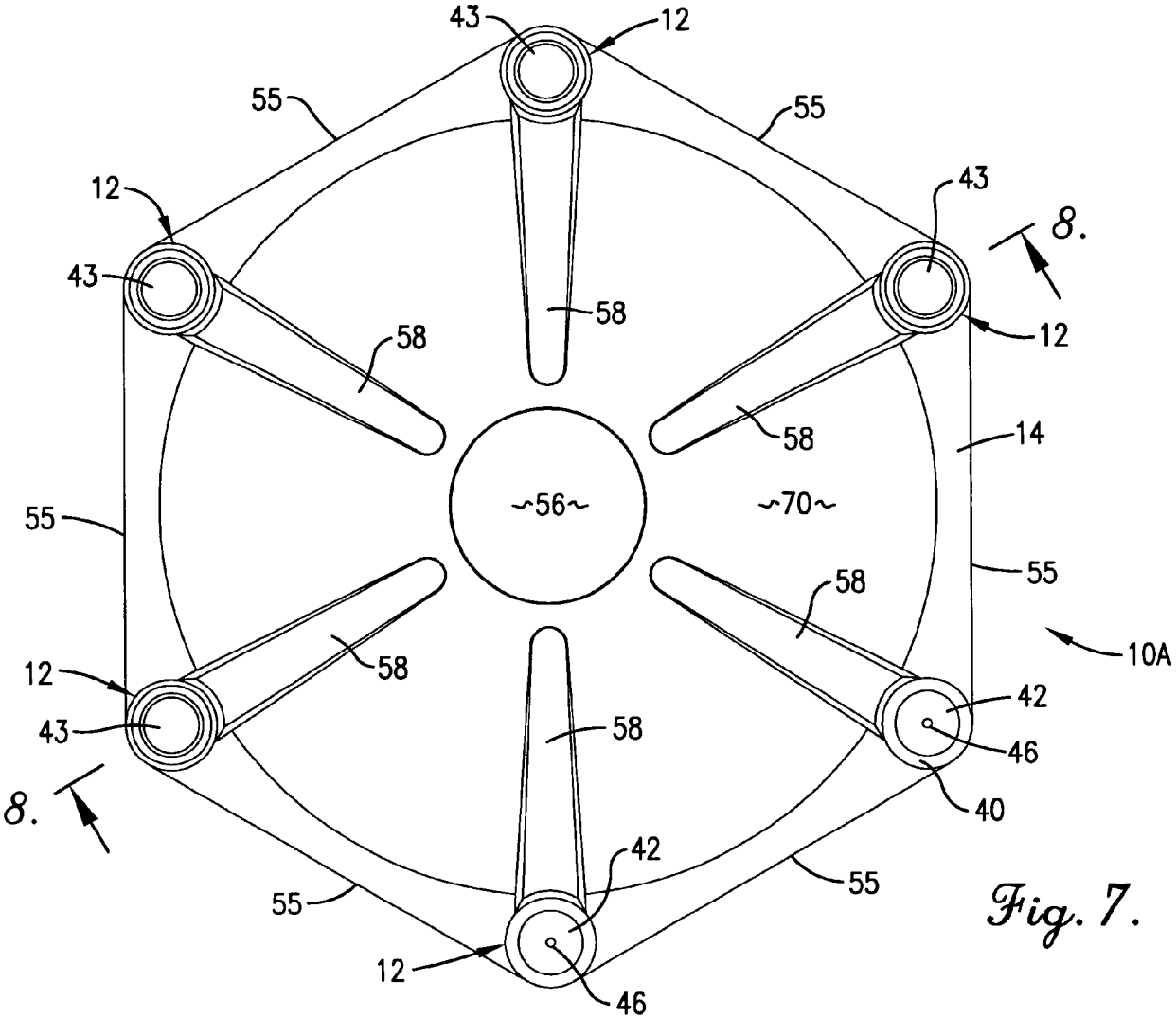
FIG. 7 is a top plan view of the tank support of FIG. 6, showing two of the plugs removed to reveal the access through the legs.
Figure 8:
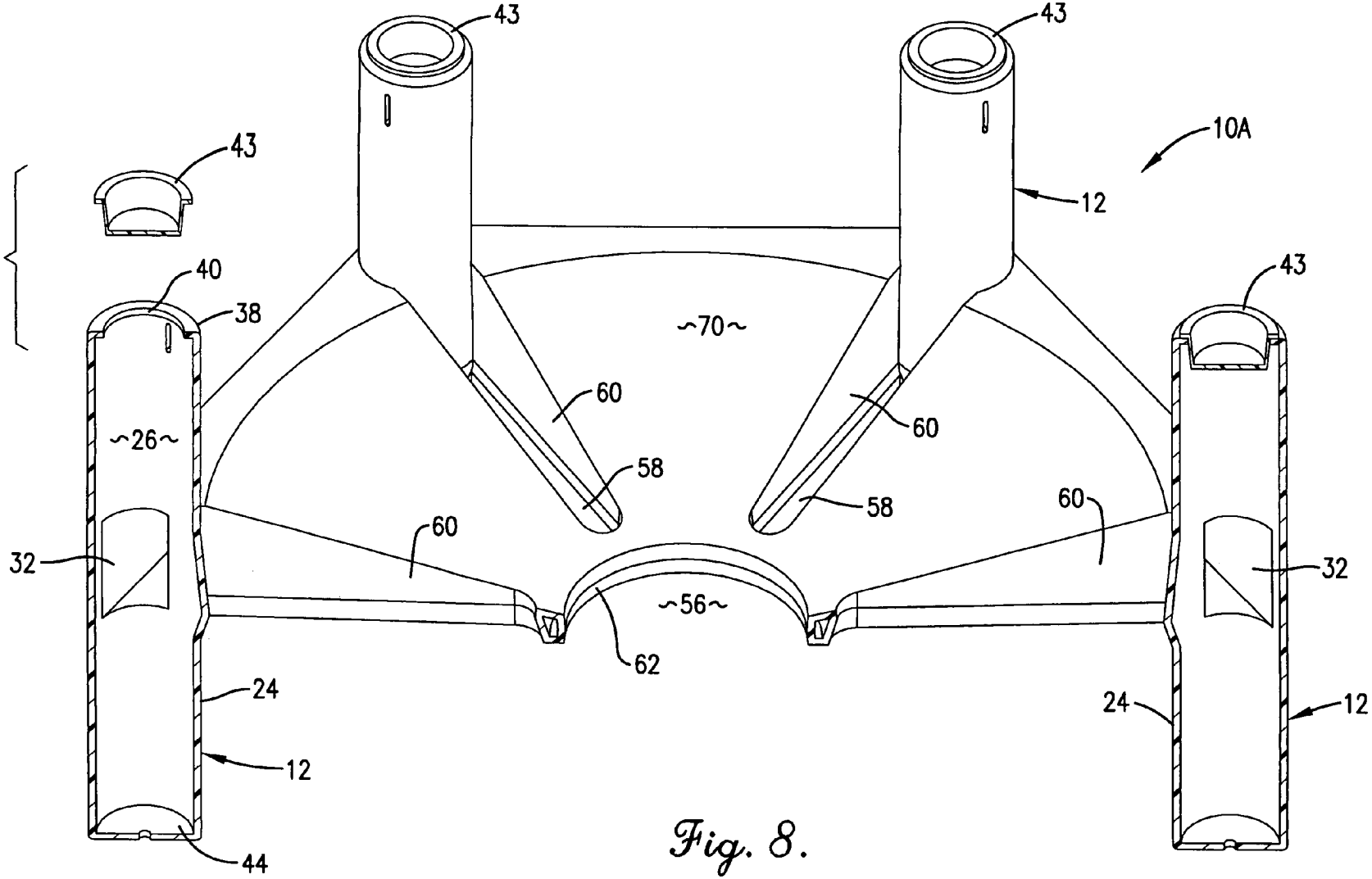
FIG. 8 is an exploded sectional view in perspective and taken along line 8—8 of FIG. 6, showing the plugs received in the legs and with the flat surface bottommost.

Referring now to the drawings, an industrial tank support 10 in accordance with the present invention is shown in FIGS. 1–5, with an alternate embodiment of the industrial tank support 10A shown in FIGS. 6–8. Features of the two embodiments which are common to both share the same reference characters. Broadly speaking, the industrial tank support hereof includes a multiplicity of normally upright legs 12 and a platform 14 for supporting an industrial tank 16 thereon whereby the legs and platform elevate the tank 16 above a floor 18 or other supporting surface. The platform 14 includes a first surface 20 of a first configuration compatible for supporting a tank 16 thereon where the tank has one bottom configuration, and a second surface 22 of a second configuration compatible for supporting a different tank thereon with a different bottom surface. In the description hereof, the descriptions "top" and "bottom" and the like refer to the orientation of the tank support 10 as illustrated, it being understood that the tank support 10 is designed to be inverted to accommodate differently configured tanks and thus the description of the orientation is for ease of reference to the drawings.

Figure 4:
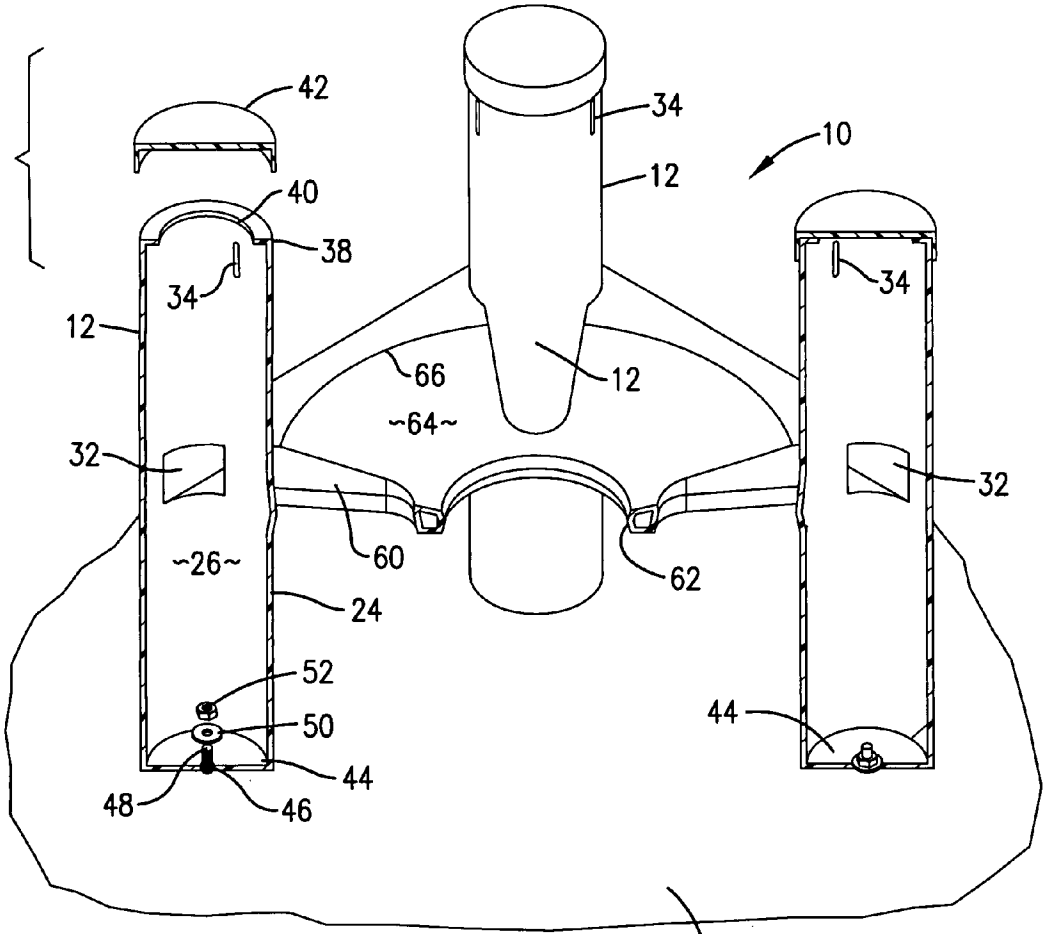
FIG. 4 is an exploded, sectional view of the tank support shown in perspective and taken along line 4—4 of FIG. 2, showing the cap above one of the legs and the caps mounted to the other two legs depicted, the interior walls adjacent the legs, the fluidic communication between the platform and the legs, and the use of threaded fasteners for anchoring the tank support to the floor.

In greater detail, the industrial tank support 10 hereof is hollow, and the legs 12 each have a sidewall 24 which defines a cavity 26, while the platform 14 has a platform wall 28 which defines a chamber 30. The cavity 26 of each of the legs 12 is in fluid communication with the chamber 30 of the platform 14 through passages 32 as shown in FIGS. 4 and 8. To provide this arrangement, the industrial tank support 10 hereof is preferably rotationally molded of a synthetic resin such as high density polyethylene (HDLPE).

Each of the legs 12 is thus substantially tubular and preferably the sidewall 24 is substantially circular in cross-section. The sidewall 24 may be provided with transverse slots 34 which permit a strap 36 to be passed therethrough, the strap 36 preferably passing through all of the legs 12 whereby the tank 16 is further constrained by the strap 36 and the legs 12. While the legs 12 may be provided with an enclosed top end and bottom end, it may be desirable to have the top end 38 provided with an opening 40 to gain access to the cavity 26. The opening 40 may be covered by a cap 42 as shown in FIGS. 1, 2, 4 and 5, or a plug 43 as shown in FIGS. 6, 7 and 8. The bottom end 44 may be enclosed, or a hole 46 may be provided in the bottom end 44 whereby a threaded fastener such as a bolt 48 may pass through the hole 46 and by attaching a washer 50 and a nut 52 onto the bolt 48, the industrial tank support 10 may be firmly anchored to the floor 18 as shown in FIG. 4. By providing an opening 40 at the top end 38, access may be gained through the cavity 26 in order to use a wrench or other tool on the nut threaded on the bolt 48 (or a screw driven into the floor 18). The legs 12 are preferably located at the corners of the platform 14 to provide stability and so that the legs 12 are positioned around the exterior of the tank 18 received on the platform 14 to provide protection against impact.

The platform 14 is preferably unitary with the legs 12 so that the tank support 10 is substantially molded in one piece. The platform wall 28 includes the first surface 20 and the second surface 22 and the chamber 30 therebetween. An outer wall 54 extends between the legs 12 and has a plurality of substantially planar wall segments 55. The outer wall 54 is positioned whereby each wall segment 55 of the outer wall is substantially tangent to the sidewall 28 of the legs 12 between which the segment is located. The platform wall 24 also preferably includes a central passage 56 defined by a center wall 62 which may be substantially circular as illustrated, whereby an outlet for a tank received thereon maybe located in the passage 56 for dispensing liquid from the tank 16 with the outlet located above the floor 18. The platform 14 also includes a plurality of portals 58 positioned adjacent the legs 12 and extending inwardly toward the central passage 56. The portals 58 are open between the first surface 20 and the second surface 22 and have upright interior walls 60 which serve not only to enclose the chamber 30 but also to provide support between the first surface and the second surface to enhance the load bearing capability of the platform 14.

Figure 1:
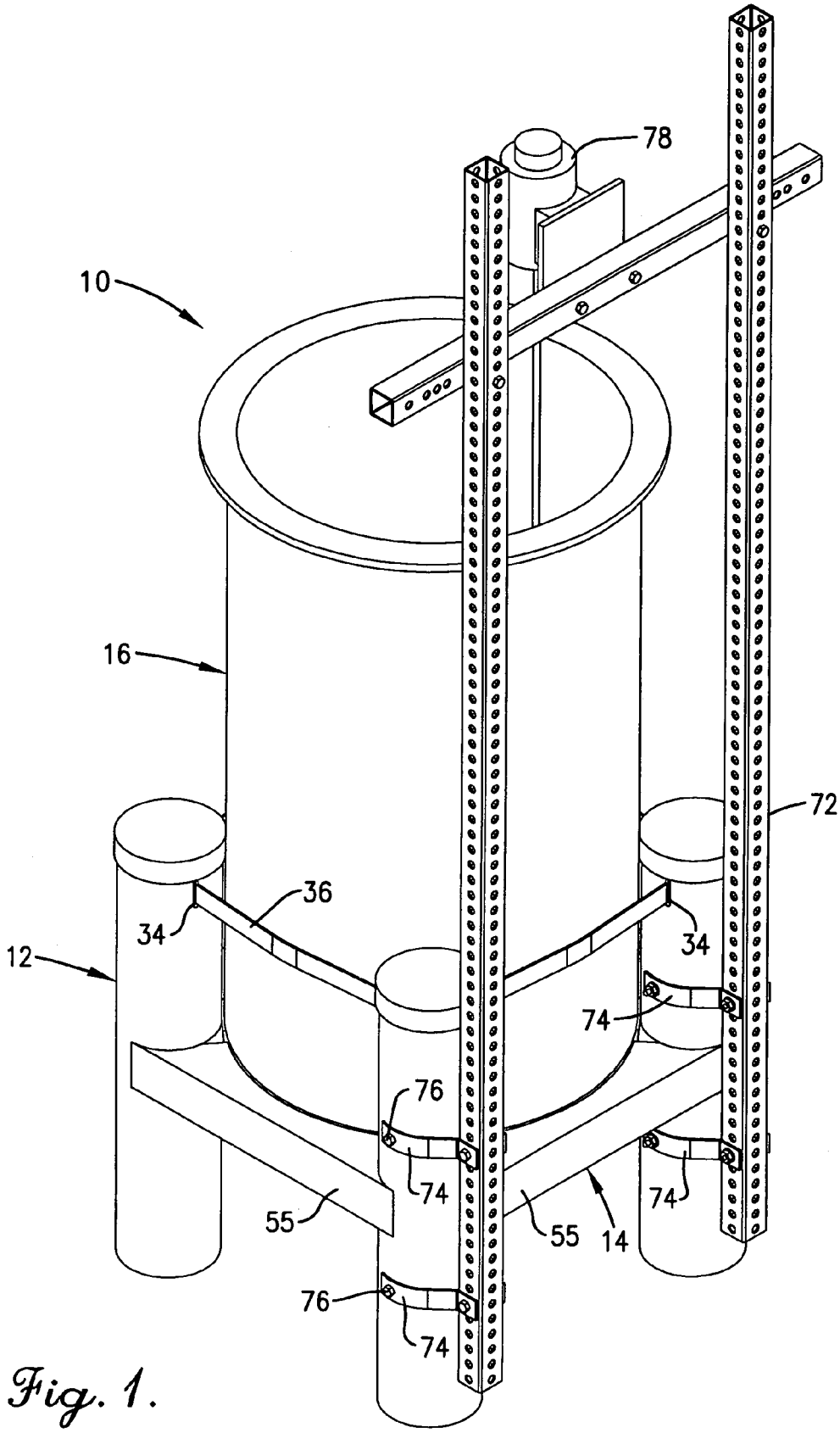
FIG. 1 is a perspective view of a tank support in accordance with the present invention showing a tank received on the platform of the support and a stand supporting a tank stirrer coupled to the legs of the tank support.
Figure 2:
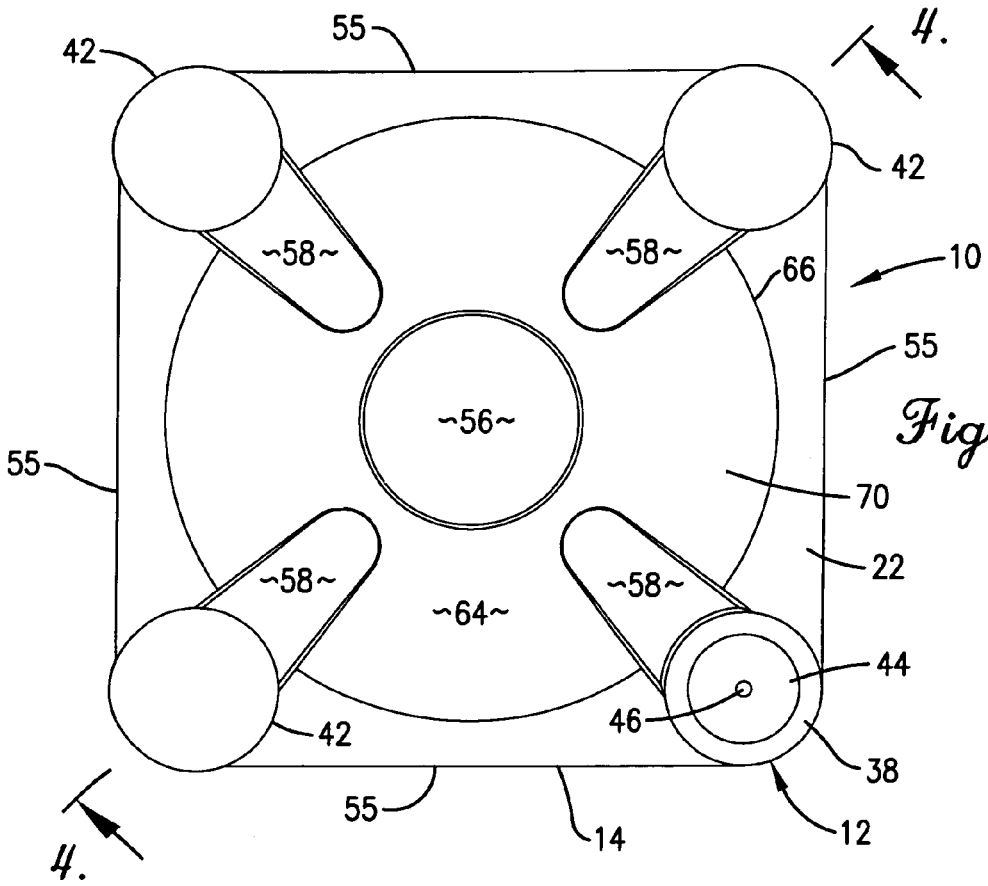
FIG. 2 is a top plan view of the tank support, with a cap on one of the legs removed to illustrate access to the interior of the leg.
Figure 3:
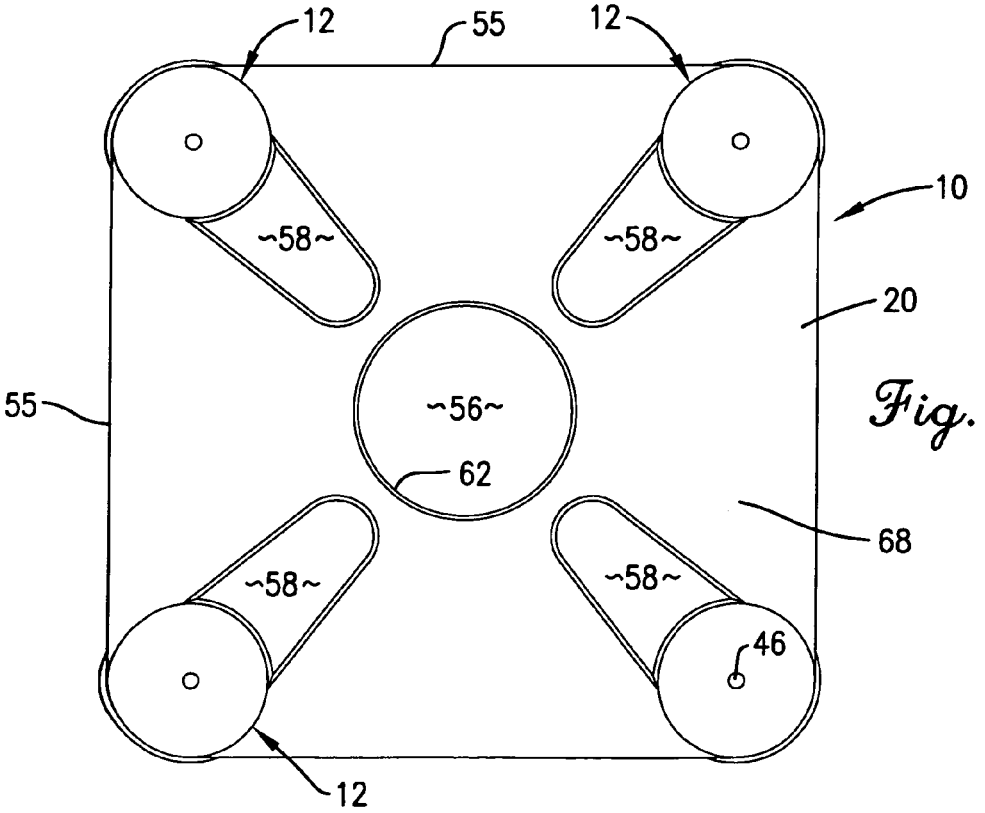
FIG. 3 is a bottom view of the tank support showing holes cut in the bottom end of the legs for the receipt of fasteners therethrough.

In the embodiment illustrated, the first surface is substantially flat and level when the tank support rests on the legs 12 in the orientation shown in FIG. 1 or in an inverted position. The second surface 22 includes a recess 64 which is bounded by a edge 66. The edge 66 helps to retain a tank 16 received on the platform 14 in position. Thus, while the first surface 20 is available substantially entirely as a first tank supporting surface 68, the second surface 22 has a second tank supporting surface which is within the edge 66 and around the central passage 56. When viewed in plan, the recess 64 and its corresponding generally annular tank receiving surface 70 are bounded by the generally circular edge 66 as illustrated, but it may be appreciated that the recesses may be rectangular or of other configurations in which are complemental in size and shape to the bottom surface of the tank 16 to be received thereon, and that a recess and bounding edge could be provided on the first surface as well. The length of the legs 12 between the top end and the bottom end may be varied depending on the desired elevation of the tank to be supported on the platform. The platform 14 is preferably located about midway between the top end and the bottom end of the legs 12, whereby the user may invert the tank support 10 depending on the configuration of the bottom wall of the tank 16 to be received. For example, the tank support 10 may have a first surface 20 which has a tank receiving surface 68 which is substantially flat and horizontal in an unloaded configuration, whereby a tank 16 with a flat bottom wall is supported thereon. The second surface 22 as illustrated has a respective second tank supporting surface 70 within recess 64 which is sloped or angled downwardly toward the central passage 56 when the second surface 22 is atop the first surface 20. The second tank supporting surface may be either sloped in a frustum shape or concave. Thus, the distance between the first surface 20 and the second surface 22 is greater when measured adjacent the outer wall 54 than when measured adjacent the central passage 56 as shown in FIG. 5. The second surface 22 thus supports a tank 16 which has a bottom wall which is domed or convex. The upright interior walls 60 help to maintain the respective spacing between the first and second surfaces even when a tank is placed thereon. In this way, one tank support 10 may support tanks 16 with different bottom configurations by providing improved support and contact between the platform 14 and the tank 16, while still elevating the tank 16 above the floor 18 and permitting drainage through the central passage 56.

Tank support 10 and tank support 10A are similar in construction and use, tank support 10 being illustrated in FIGS. 1–5 as having 4 evenly spaced legs 12 about the perimeter of the platform which is rectangular in plan, while tank support 10A as illustrated in FIGS. 6–8 has six evenly spaced legs 12 with its platform 14 being hexagonal, each with a corresponding number of inwardly extending portals 58. Thus, it maybe appreciated that three or more legs 12 maybe used and the platform 14 shaped corresponding to the number of legs 12 used. Thus, a tank support 10 with three legs 12 would preferably have a platform which is triangular in plan, a tank support with five legs would preferably have a platform which is pentagonal in plan, and so forth.

In use, the tank support 10 or 10A is preferably rotationally molded of HDLPE or other suitable synthetic resin material. The tank support is suitable for use as molded in unitary condition, with the user selecting whether the first surface 20 or the second surface 22 is to be uppermost in a tank supporting orientation depending on the bottom wall configuration of the tank 16 to be supported. As noted above, the tank support maybe readily modified for specific applications. If it is desired for water, sand or other material to be placed into the hollow tank support, the top end of one of the legs 12 may be cut open and the ballast poured into the leg or legs. If water is used, only one opening into one leg need be provided, as the water may move through the passages into the cavities of the other legs 12 by passing through the chamber of the platform and into the other legs with which it is in fluid communication. If it is desired to use threaded fasteners to anchor the tank support to the floor 18, the top ends of the legs 12 may be cut open to provide the openings 40 and a hole 46 drilled or otherwise cut into the bottom end, with the threaded fastener passing through the hole 46 as illustrated in FIG. 4. Caps 42 or plugs 43 may then be used to enclose the openings 40 in the legs. If after initial use with one tank 16, another tank with an alternate bottom wall configuration is to be used, then the tank support 10 or 10A may be inverted so that the new tank may be placed on a complementally configured supporting surface of the platform 14.

Also, the present invention provides for further modification of an initially rotationally molded tank support 10 or 10A. For example, transverse slots 34 may be cut or molded into the legs 12 adjacent one or both of the top end and the bottom end, whereby strap 36 may be routed through the slots 34 to help hold and stabilize the tank 16. Additionally, a stand 72 may be coupled to the legs 12 as illustrated in FIG. 1. The stand 72 may be coupled using mounting bands 74 which are held by bolts 76 or other threaded fasteners extending into the legs 12. The stand may be used, for example, to mount a stirrer 78 over the tank 16 whereby the liquid contents of the tank may be agitated to a homogenous mixture for dispensing therefrom.

Although preferred forms of the invention have been described above, it is to be recognized that such disclosure is by way of illustration only, and should not be utilized in a limiting sense in interpreting the scope of the present invention. As used herein, the term "tank" is intended to mean vessels or other liquid containers, with the particular configuration of the tank shown in FIG. 1 intended to be illustrative rather than limiting. It is to be understood that vessels of various sizes and configurations may be stored on the tank support hereof, and that the platform may be constructed with first and second surfaces capable of receiving tanks with projections, ridges or the like in a variety of different configurations. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. A tank support operable to alternately support first and second tanks above a supporting surface, said first and second tanks having respective, different, first and second bottom surfaces, said tank support comprising:

a multiplicity of legs each having one and another opposed ends, with each opposed end including structure for engaging said supporting surface; and a platform coupled to the legs between said opposed ends thereof and presenting opposed, first and second platform surfaces each including respective first and second tank-supporting structures, said first and second structures being asymmetrical in vertical cross-section, said tank support being positionable with one of said platform surfaces facing upwardly and one multiplicity of leg end structures engaging said supporting surface, and alternately positionable with the other of said platform surfaces facing upwardly and with the other multiplicity of leg end structures engaging said supporting surface, said first tank-supporting structure configured to support the first tank having the first bottom surface thereon when the tank support is positioned on said supporting surface with said first platform surface facing upwardly, said second tank-supporting structure configured to support the second tank having the second bottom surface thereon when the tank support is positioned on said supporting surface with said second platform surface facing upwardly.

2. A tank support as set forth in claim 1, wherein the platform includes a central passage extending through said structures.

3. A tank support as set forth in claim 2, wherein the central passage is substantially circular.

4. A tank support as set forth in claim 2, wherein at least one of the first and second structures includes an edge surrounding a recess with the respective structure located interiorly of the edge and outside the central passage.

5. A tank support as set forth in claim 1, wherein the platform includes a platform wall enclosing a chamber and each of the legs includes a sidewall enclosing a cavity therein, such that the chamber of the platform is in fluidic communication with at least one of the cavities of the legs.

6. A tank support as set forth in claim 1, wherein said first structure is substantially flat and horizontal when the tank support is supported on said legs.

7. A tank support as set forth in claim 6, wherein said platform has a central passage and said second structure is sloped inwardly toward said central passage.

8. A tank support as set forth in claim 7, wherein said second structure is substantially frustum shaped.

9. A tank support as set forth in claim 1, wherein each of said first and second structures is bounded by a respective edge and said first and second structures are recessed relative to their respective surrounding edges.

10. A tank support as set forth in claim 1, wherein said platform and said legs are unitary and molded of synthetic resin.

11. A tank support as set forth in claim 1, wherein said legs have a transverse slot.

12. A tank support as set forth in claim 11, further including a strap received in said transverse slots of said legs.

13. A tank support as set forth in claim 1, wherein said multiplicity of legs includes at least four of said legs spaced equidistantly around said platform.

14. A tank support as set forth in claim 13, wherein said legs include a sidewall located between said one and another opposed ends and wherein said platform is substantially rectangular in plan and includes an outer wall having substantially planar wall segments which are substantially tangent to the sidewall of said legs.

15. A tank support as set forth in claim 1, wherein said multiplicity of legs includes at least six of said legs spaced equidistantly around said platform.

16. A tank support as set forth in claim 15, wherein said platform is substantially hexagonal in plan and includes an outer wall having substantially planar wall segments which are substantially tangent to the sidewall of the legs.

17. A tank support as set forth in claim 1, further including a stand coupled to at least one of the legs.

18. A tank support as set forth in claim 17, including a stirrer mounted on the stand.

19. A tank support as set forth in claim 1, wherein the one end of at least one of the legs has an opening therethrough for gaining access to the cavity.

20. A tank support as set forth in claim 19, including means removably mounted on the one end of said at least one of the legs having an opening for covering the opening.

21. A tank support as set forth in claim 19, wherein the another end of said at least one of the legs opposite the one end has a hole therein sized for receiving a threaded fastener.

22. A tank support as set forth in claim 1, wherein said platform includes portals extending through the platform and located adjacent respective ones of said legs, said platform further including upright interior walls extending between said first and second structures and surrounding said portals.

23. A method of alternately supporting first and second tanks each having respective differently configured first and second bottom surfaces tanks above a supporting surface, said method comprising the steps of:

providing a platform presenting opposed first and second platform surfaces each including respective first and second tank-supporting structures, said first and second structures being asymmetrical in vertical cross-section;

if said first tank is to be supported, orienting and mounting said platform above said supporting surface with said first platform surface facing upwardly, and then positioning said first tank with said first bottom surface on said first tank-supporting structure; and if the second tank is to be supported, orienting and mounting said platform above said supporting surface with said second platform surface facing upwardly, and then positioning said second tank with said second bottom surface on said second tank-supporting structure.

24. The method of claim 23, there being a multiplicity of legs having opposed ends, said platform being coupled to said legs between the opposed ends thereof, said platform mounting steps comprising the step of setting the corresponding ends of said legs on said supporting surface.

* * * * *